United States Patent [19]

Huang

[11] Patent Number: 4,604,836

[45] Date of Patent: Aug. 12, 1986

[54] SAFETY CUTLERY CASE WITH SHARPENING DEVICE

[76] Inventor: Francke L. D. Huang, 300, Nan Ta Wan, Yung Kang Village, Tainan, Taiwan

[21] Appl. No.: 682,275

[22] Filed: Dec. 17, 1984

[51] Int. Cl.[4] ..... B24B 3/54; B24D 15/08

[52] U.S. Cl. ..... 51/214; 30/138

[58] Field of Search ..... 30/138; 51/214, 210, 51/211

[56] References Cited

U.S. PATENT DOCUMENTS

| | | | |
|---|---|---|---|
| 2,413,169 | 12/1946 | Case | 51/214 |
| 2,826,879 | 3/1958 | Evans | 51/214 |
| 3,676,961 | 7/1972 | Jackson | 30/138 X |
| 4,041,651 | 8/1977 | Bayly | 51/214 |

*Primary Examiner*—Jimmy C. Peters

*Attorney, Agent, or Firm*—Bacon & Thomas

[57] ABSTRACT

This invention relates to a safety cutlery case with sharpening device in which resilient means and sharpening means are provided to secure the knives in place and to offer a sharpening when the knives are driven into or pulled out of the case.

2 Claims, 4 Drawing Figures

SAFETY CUTLERY CASE WITH SHARPENING DEVICE

The present invention relates to safety cutlery case with built-in sharpening device, in which each individual knife is resiliently secured in place and is meanwhile sharpened when drawn out or driven in.

The knife play an indispensible role in kitchen. For different purposes, various knives must be provided. However, the knives are often hanged to a rack or laid flat. Thus unsheathed knives are often directly exposed to the air and is therefore prone to rust. Moreover the unsheathed edge may hurt the children.

Various knife holders have been developed, and among them, some are provided with sharpening means which enable a knife to be sharpened while being drawn out of or driven into the holder. But they have not proven altogether satisfactory. When a knife holder is provided with such sharpening means, it must be driven into a slot with its edged side in coincidence with the side provided with sharpening means. For safety purposes, the knife holder must be such that the knives are held with their edged side facing downward. At present, there is a tendency to mount the holders on the underside of a shelf so as to save the space in a kitchen jammed with kitchen-wares. If a person desires to mount the knife holder under a cabinet to save space, the base must be fixed to the underside of the cabinet. In such a mounting, the knife holder becomes upside down. Accordingly, the user has to suffer the threatening upward facing cutting edges of the knives whenever he draws the knives out or drives them in. Accordingly, it is the object of this invention to provide a knife holder which obviates this drawback of the prior art.

According to this invention, the problem is solved by providing a detachable front panel which, together with the receiving means of the knives, forms a detachable entity. The front panel must be symmetrical so that it can be inversely remounted.

This invention will be better understood when read in connection with the accompanying drawing in which:

DETAILED DESCRIPTION OF THE DISCLOSURE

Figure 1:
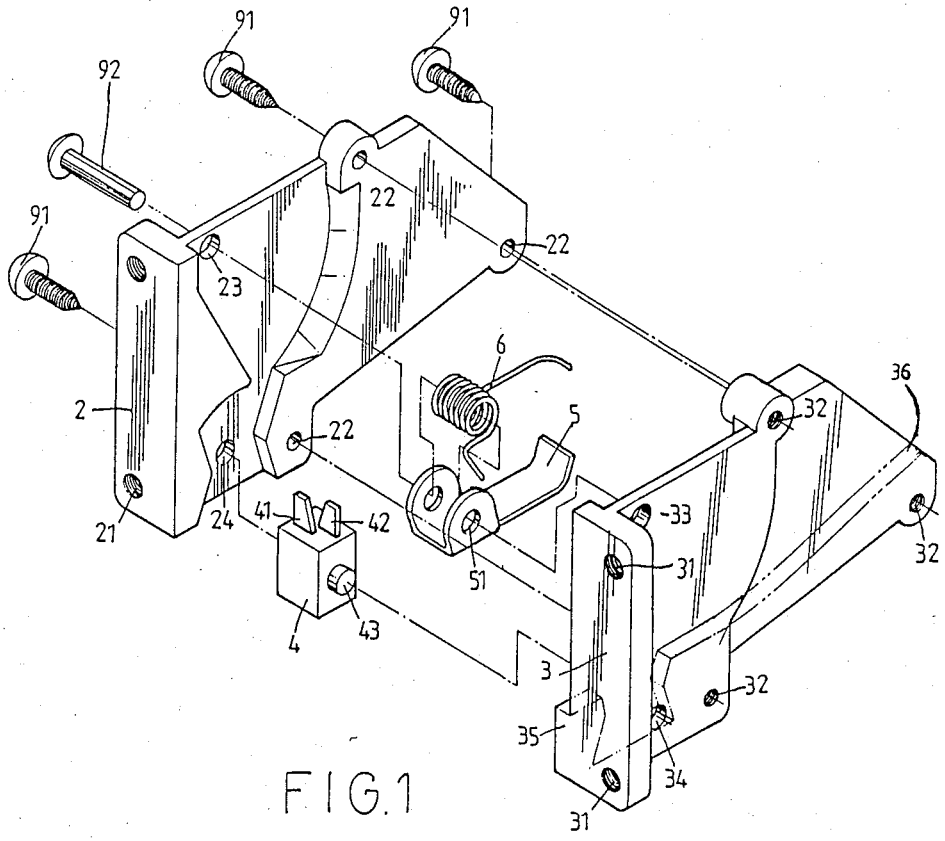
FIG. 1 is a fragmentary perspective view of this invention.
Figure 4:
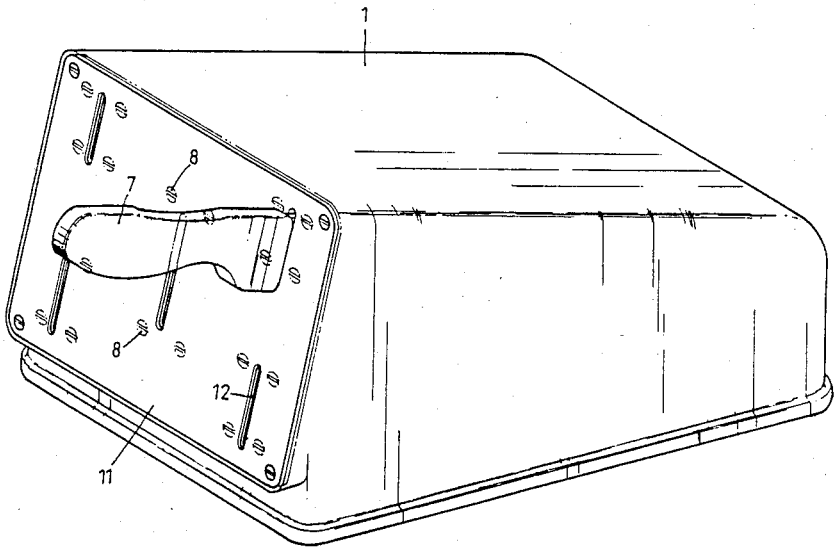
FIG. 4 is an external perspective view of this invention.

With reference to FIGS. 1 and 4, this invention is a cutlery case comprising a casing (1), in which are provided with a plurality of loaders for receiving various kinds of knives (7). Each loader consists of two side members (2) (3). The inner side of side member (3) is provided with an irregular recess (36). On the side members (2) (3) there are provided holes (21) (22) (23) (31) (32) (33) for passing screws (8) (91) or pins (92). A sharpening seat (4) is provided with two alloy pieces (41) (42) of high hardness arranged to leave an approximate X-shaped gap therebetween, with the intersecting angle of the opposite, sloped edges of the two pieces corresponding to the slopes of the two sides of the blade of the knife. Two projections (43) are provided (only one is shown in FIG. 1) to be fitted into the holes (24) (34). Thus the sharpening seat is retained in the recess to make limited pivotal movement. A ski-shaped pressing member (5) is provided with holes (93) so that it can be pivoted to the pin (92) with the torsion spring (6). The parts in FIG. 1 are assembled to make a loader. The front panel (11) is provided with slots (12) and is fastened to the loaders by means of screws (8).

Figure 2:
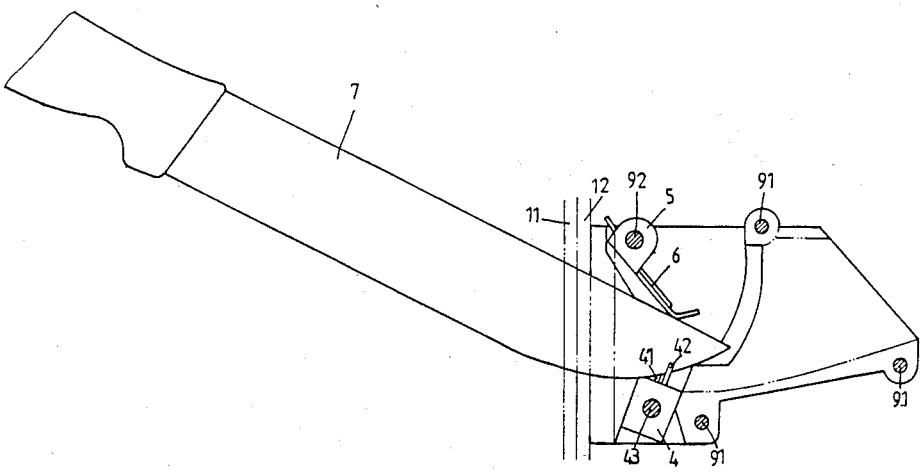
FIG. 2 is a graphical representation showing a knife just beginning to be inserted into a loader.
Figure 3:
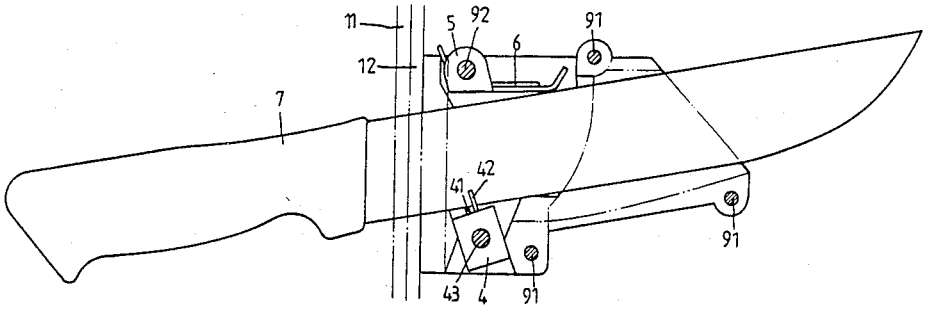
FIG. 3 is a graphical representation showing the knife in FIG. 2 after inserted into the loader.

Referring to FIG. 2, when the anterior portion of a knife (7) is inserted into the loader through slot (12), its blade passes frictionally between the alloy pieces (41) (42). Meanwhile the opposite blunt (unedged) side of the blade repels the pressing member (5) away. Hereto the whole blade is inserted into the case. The pressing member (5) resiliently retains the knife in position, so that the knife does not fall outside even if one hold the case with the slotted side (and therefore the handles of the knives) downward.

When the blade is driven into or drawn out of the case, the edge is rubbed against the alloy pieces (41) (42) to achieve a sharpening. The sharpening seat can make a certain degree of pivotal movement to reduce the resistance to the blade which is being pushed into or pulled from the loader, thus providing a sufficient abrasion against the blade while not damping the movement of the knife.

The front panel (11) must be symmetrical about its horizontal middle line, and is preferably rectangular in shape. When it is desired to mount the cutlery case upside down, the four corner screws are loosened, and the panel, together with the knife receiving means (loaders) (2) (3), is dismounted and then inversely remounted. Thus, the knives can still be held with their blades still facing downwardly despite the upside down orientation of the housing. This enables such a device to be converted into a safe knife holder while mounted upside down on the underside of a shelf.

I claim:

1. A device for storing and sharpening cutlery comprising:

(a) a case defining an interior storage space;

(b) a front panel defining a plurality of slots to facilitate the passage of a cutlery blade therethrough;

(c) attachment means removably and reversibly attaching the front panel to the casing;

(d) a pair of side members attached to the front panel on either side of each slot so as to define a cutlery blade passage therebetween;

(e) sharpening means pivotally attached between the pair of side members; and (f) spring biased means pivotally mounted between the pair of side members bearing against a cutlery blade so as to urge a cutting edge of the cutlery against said sharpening means as the cutlery is inserted into or withdrawn from the case.

2. The device according to claim 1 wherein the sharpening means comprises:

(a) a seat;

(b) means pivotally attaching the seat between the pair of side members; and, (c) a pair of sharpening members attached to the seat in parallel planes and extending into the cutlery passage, each sharpening member having a sharpening edge, the sharpening edges of the two sharpening members defining a generally "V" shaped gap therebetween.

* * * * *